US006349971B2

(12) United States Patent
McCarthy

(10) Patent No.: US 6,349,971 B2
(45) **Date of Patent: *Feb. 26, 2002**

(54) ADHESIVE TRANSACTION RECEIPTS

(75) Inventor: Daniel B. McCarthy, Framingham, MA (US)

(73) Assignee: BAL Systems, G.P., Devens, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/252,248

(22) Filed: Feb. 8, 1999

(51) Int. Cl.[7] ..... B42D 15/00; G07G 1/00

(52) U.S. Cl. ..... 283/60.1; 283/60.2; 283/66.1; 283/66.2; 283/67; 283/101; 462/64

(58) Field of Search ..... 283/60.1, 101, 283/60.2, 67, 66.1, 66.2; 462/64

(56) References Cited

U.S. PATENT DOCUMENTS

| | | | | |
|---|---|---|---|---|
| 1,608,294 A | | 11/1926 | Beman | |
| 2,693,909 A | | 11/1954 | Allan | 235/61.12 |
| 3,455,576 A | | 7/1969 | Hammerling | 283/7 |
| 4,346,917 A | | 8/1982 | Clancy | 283/58 |
| 4,689,018 A | * | 8/1987 | Trinity | 434/109 |
| 4,944,532 A | * | 7/1990 | Pollard | 283/70 |
| 4,948,174 A | * | 8/1990 | Thomson et al. | 283/58 |
| 4,974,878 A | * | 12/1990 | Josephson | 283/58 |
| 5,011,559 A | | 4/1991 | Felix | 156/257 |
| 5,022,683 A | | 6/1991 | Barbour | 283/58 |
| 5,071,167 A | | 12/1991 | O'Brien | 283/79 |
| 5,121,945 A | | 6/1992 | Thomson et al. | 283/58 |
| 5,440,106 A | | 8/1995 | Duck | 235/3 |
| 5,673,944 A | | 10/1997 | Walker et al. | 283/81 |

FOREIGN PATENT DOCUMENTS

EP 0 836 952 A1 10/1997

* cited by examiner

*Primary Examiner*—A. L. Wellington
*Assistant Examiner*—Mark T. Henderson
(74) *Attorney, Agent, or Firm*—Ropes & Gray

(57) ABSTRACT

The invention is an account management system using an adhesive transaction receipt, provided at the point of transaction, which can be directly transferred to an account register. In this system, the adhesive transaction receipt contains a printed record of information relating to the transaction, such as the transaction type and the amount of the transaction. The adhesive transaction receipt is temporarily affixed to a more complete transaction receipt and includes an adhesive so that it can be permanently attached to the account register. The adhesive transaction receipt simplifies bookkeeping and eliminates errors by relieving an account user of the requirement of entering individual transactions by hand.

15 Claims, 3 Drawing Sheets

ADHESIVE TRANSACTION RECEIPTS

FIELD OF INVENTION

This invention relates to a system for tracking financial transactions. More specifically, the invention relates to the use of transaction receipts which include an adhesive record portion for direct transfer to a transaction account register.

BACKGROUND OF THE INVENTION

In conventional bookkeeping systems associated with personal bank accounts, each transaction is memorialized by a transaction receipt. This receipt will include a description of the transaction, e.g., a withdrawal, a deposit, a service fee, a transfer, or some other transaction type. The receipt also includes the amount of the transaction, along with a date, an account number, and any other information used by a bank or an individual to track the transaction. The receipt may be prepared by a bank teller, or may be produced by an automatic teller machine (ATM), depending on the location where the transaction is conducted. In this well known procedure, the individual using the account must still retain the transaction receipt, and transfer the contents therein to an account register by hand in order to accurately maintain up-to-date account balances.

Aside from being tedious, this hand-entry procedure is prone to error, particularly when the account user must enter numerous transactions at one time. One approach to this problem is addressed in U.S. Pat. No. 5,440,106 to Thomas S. Duck, entitled "Point-of-Sale Check Writing Assist Apparatus." The '106 patent describes a system in which blank portions of a check are printed onto adhesive labels for direct transfer to checks, thus freeing the check payor from the task of completing a check by hand. The '106 patent further describes a peel-and-stick label which may be placed into a checkbook account register for later balancing of a checkbook.

However, there are numerous other types of bank accounts, and there are numerous other types of transactions which may be conducted with a bank account. With the introduction of ATM's, a checking account may frequently have more non-check transactions than check transactions. Accordingly, there remains a continuing need for a simple, automated account transaction management system.

SUMMARY OF THE INVENTION

The invention is an adhesive transaction receipt to simplify bookkeeping for bank accounts. According to the invention, a receipt is provided relating to a completed financial transaction. The receipt is provided from a bank teller, from an ATM, or from some other individual or institution engaged in financial transactions. The receipt includes an adhesive portion which contains information relating to the transaction. In order to enter a record of the transaction into an account register, the adhesive portion is removed from the transaction receipt and transferred to an appropriate location within the account register.

The adhesive transaction receipt is a self-adhesive, or so-called "peel-and-stick," label. It is shaped and sized for direct transfer to an account register. The adhesive transaction receipt can be a single, integrated label affixed to a release sheet within the body of a complete receipt. Alternatively, the complete receipt, or some portion thereof, may be printed onto a larger self-adhesive label, with the adhesive transaction receipt portion scored for removal from the remaining label portion.

The adhesive transaction receipt can also be of the type that is moistened before adhering. In this case, the adhesive portion would preferably appear along an outer edge of the complete receipt, such that it may be scored and easily detached from the complete receipt.

The adhesive transaction receipt includes a transaction type and an amount. The adhesive transaction receipt may include other information such as a date of the transaction and a current balance of the account. Account information appearing on the adhesive portion is arranged to appear in the proper column of the associated account register. The adhesive portion may be made of a transparent material so that placing the adhesive portion in the account register does not obscure the view of other information in the account register.

Another aspect of the invention is a method of personal bookkeeping using the adhesive transaction receipt to maintain account balances.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
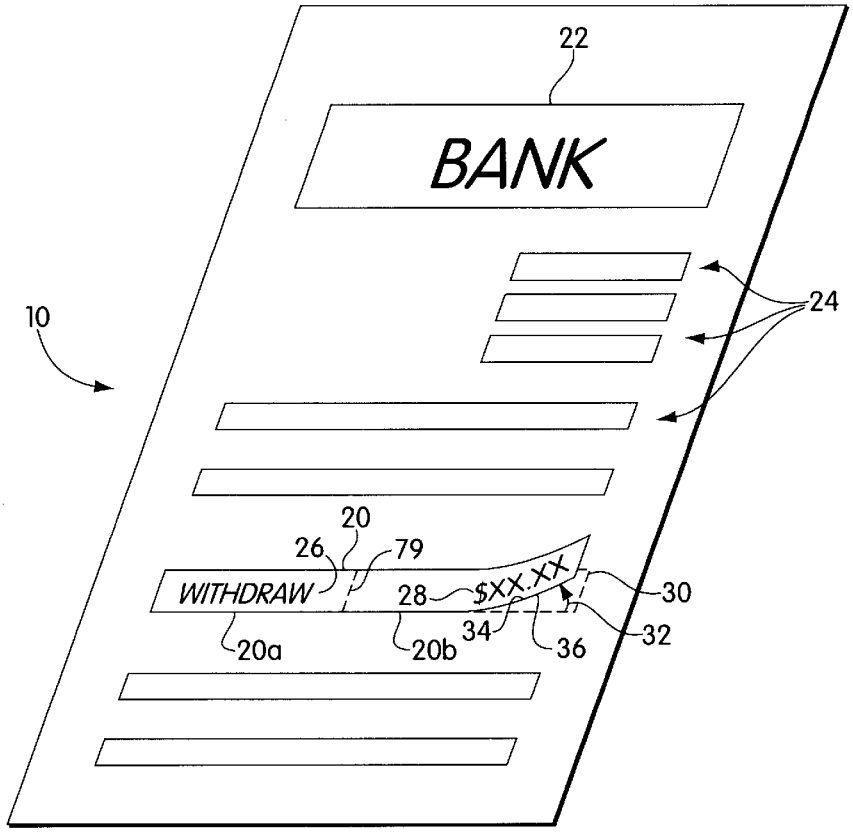
FIG. 1 shows a complete receipt including an adhesive transaction receipt that is self-adhesive.

FIG. 1 illustrates a complete receipt 10 including an adhesive transaction receipt 20 according to the present invention. As used herein, the term "complete receipt" refers to any machine-printed receipt provided from a bank, a bank teller, an ATM, or any other individual or institution engaged in financial transactions. The term "adhesive transaction receipt" is intended to refer to that portion of the complete receipt that is to be removed from the complete receipt and placed in an account register.

The complete receipt 10 is provided by an institution at the place and time where an account transaction takes place. This institution may be a financial institution such as a bank, or a retail institution such as a restaurant, supermarket, or other store. The complete receipt 10 will typically include the name of an issuing institution 22, along with information 24 relating to a completed transaction. The information 24 includes an account number, the date, the type of transaction, the amount of the transaction, and any other information used to identify the customer, the institution, or the transaction.

The adhesive transaction receipt 20 is placed within the complete receipt 10 and will contain a subset of the information 24 which a customer may wish to place in an account register. This will include a transaction type 26 and an amount 28. Although the transaction type 26 is shown as "withdraw," it should be understood that this may include any transaction type which might be performed relative to the account.

The complete receipt 10 includes a release sheet 30, also known as a non-stick backing, so that the adhesive transaction receipt 20 may be adhered to the complete receipt 10 in a non-permanent fashion. The transaction type 26 and the amount of the transaction 28 appear on an upper surface 34 of the adhesive transaction receipt 20. A lower surface 36 of the adhesive transaction receipt 20 includes an adhesive which is mated to the release sheet 30. The release sheet 30 is at least as large as the adhesive transaction receipt 20. According to the invention, the adhesive transaction receipt 20 may be removed from the complete receipt 10, as shown by an arrow 38, for transfer to an account register.

The transaction information 24, including the transaction type 26 and the amount 28, is machine printed onto the complete receipt 10. Preferably, the transaction type 26 and the amount 28 will be printed on the adhesive transaction receipt 20 and elsewhere on the complete receipt 10 so that the complete receipt will constitute a full record of the transaction after the adhesive transaction receipt 20 is removed. Many techniques for machine printing text and numbers are well known in the art, including laser printing, ink jet printing, dot matrix printing, impact printing with inked ribbons or film ribbons, and thermal printing. Any of these techniques, or other techniques, may be suitably adapted to the present invention, provided they are capable of producing a legible record of the transaction on an adhesive transaction receipt.

According to the present invention, the complete receipt 10 is provided to an account user upon the completion of a transaction. The account user can then prepare a permanent record of the transaction in an account register by peeling the adhesive transaction receipt 20 away from the complete receipt 10 and securing the adhesive transaction receipt 20 in an appropriate location of an account register. It should be understood that the specific technique used to affix the adhesive transaction receipt 20 to the complete receipt 10 is not important. Any known technique for preparing self-adhesive labels may be used to prepare the adhesive transaction receipt 20, provided that the adhesive transaction receipt 20 can be easily removed from the complete receipt 10 by an account user, and that the adhesive transaction receipt 20 can subsequently be securely affixed to an account register.

Figure 2:
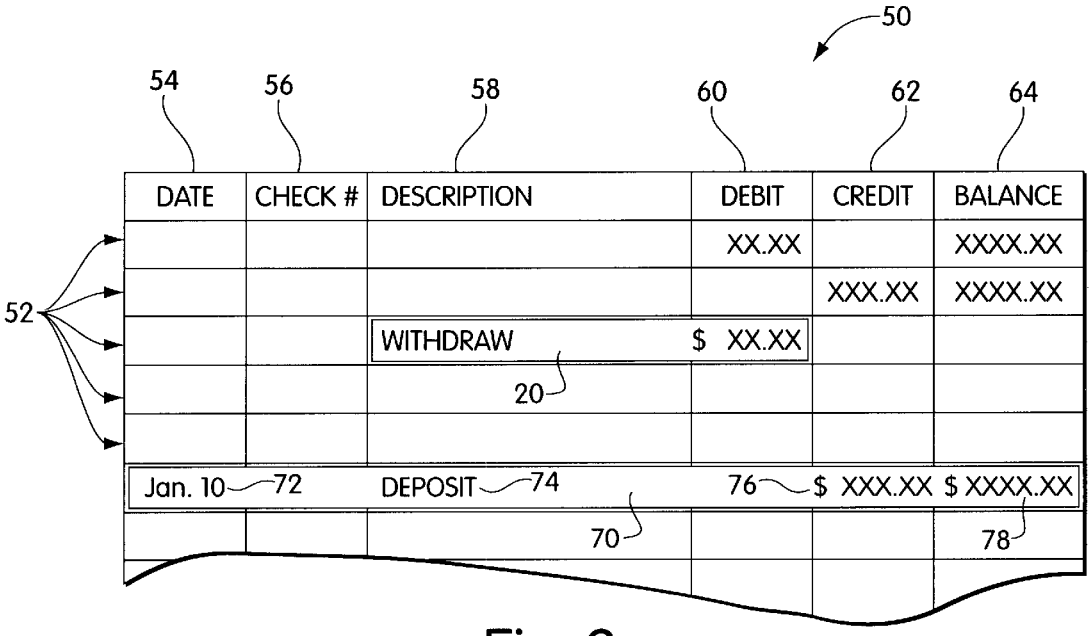
FIG. 2 shows an account register with an affixed adhesive transaction receipt.

FIG. 2 shows an account register 50 containing the adhesive transaction receipt 20. The account register is of the type accompanying a conventional checkbook. The dimensions of a page of the account register 50 are approximately 6"×2.75". The account register includes rows 52 for individual entries, and columns for transaction information such as a date 54, a check number 56 (for use with check writing transactions), a description of the transaction 58, a debit amount 60, a credit amount 62, and a balance 64. The adhesive transaction receipt 20 fits within one row 52 of the account register 50, with transaction information arranged to properly align with the columns 54–64.

FIG. 2 also shows a second adhesive transaction receipt 70 containing a more comprehensive description of a transaction. Specifically, the second adhesive transaction receipt 70 includes a record of the date of the transaction 72, the type of transaction 74, the credited amount 76, and the account balance 78. Other information may be included here, such as the name of the institution conducting the transaction, the place of the transaction, or any other information identifying the transaction.

The arrangement of the information on the adhesive transaction receipt 20 may be established by customer preferences or preferences of the issuing institution. For example a customer may find that the account balance 78 is frequently not current due to outstanding checks, or the customer may find it easier to align the adhesive transaction receipt 20, 70 within the account register 50 when the receipt 20, 70 runs the full width of a page of the account register 50. Similarly, the issuing institution may prefer to print transaction information 24 in rows, with each specific item of transaction information 24 scored for separate removal. In this latter arrangement, the adhesive transaction receipt 20 (FIG. 1) would actually comprise a plurality of individual receipts 20*a*, 20*b*, along with scoring 79 so that each individual receipt 20*a*, 20*b* can be removed separately for arrangement in the account register 50.

As a further feature, the adhesive transaction receipt 20 may be made of transparent material. In this embodiment, only the transaction type 26 and the amount of the transaction 28 will appear when the adhesive transaction receipt 20 is permanently affixed to the account register 50.

Referring again to FIG. 1, the complete receipt 10 can be adapted to a credit card transaction. In this embodiment, the complete receipt 10 is shaped and sized according to conventional credit card receipts. The transaction type 26 indicated on the adhesive transaction receipt 20 is "credit," "charge," or some similar legend, and the transaction information 24 appearing on the adhesive transaction receipt 20 includes an indication of the credit card type and credit card account number. In this embodiment, the adhesive transaction receipt 20 is not transferred to a check ledger such as that shown in FIG. 2. Instead, the adhesive transaction receipt 20 is transferred directly to a monthly statement (not shown) provided by the credit card issuer. The monthly statement preferably includes a location shaped and sized to receive the adhesive transaction receipt 20 corresponding to each transaction so that a customer can quickly and accurately match adhesive transaction receipts 20 to entries appearing on the monthly statement.

Figure 3:
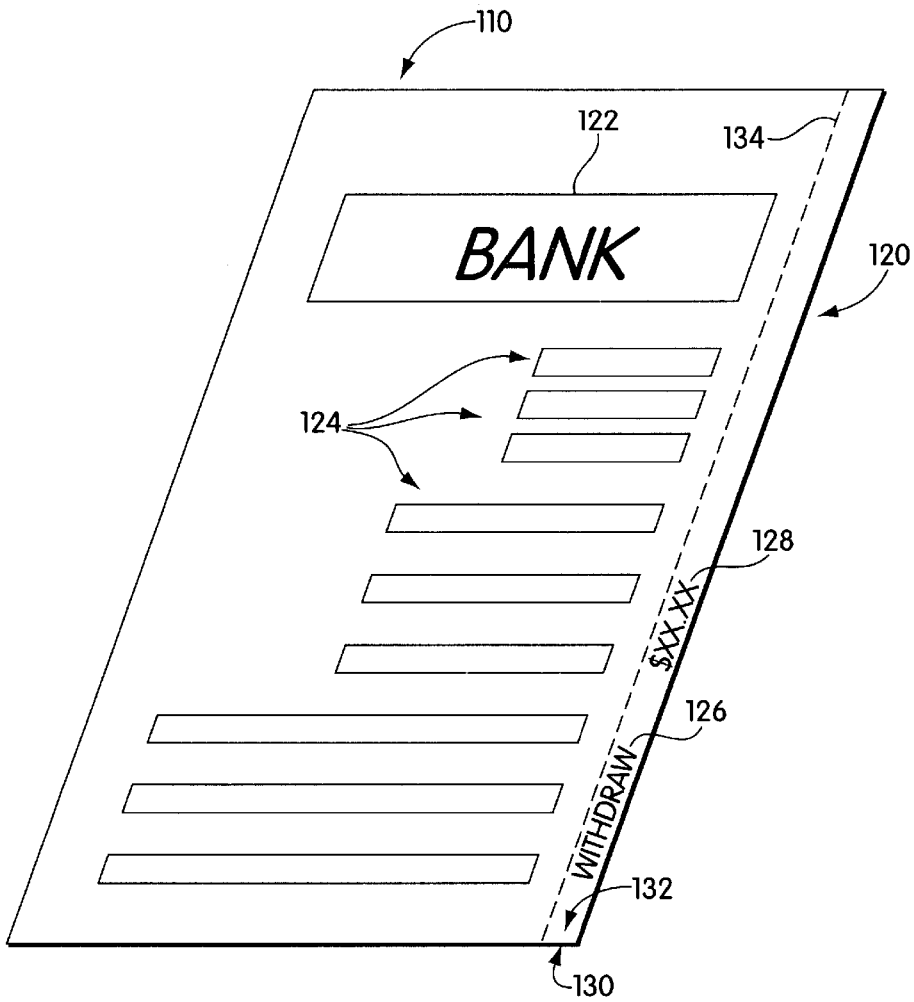
FIG. 3 shows another embodiment of the complete receipt.

FIG. 3 shows an embodiment of a complete receipt 110 using a different configuration for an adhesive transaction receipt 120 adapted to a moistened-adhesive type adhesive transaction receipt 120. The complete receipt 110 includes the name of an issuing institution 122, along with information 124 relating to a completed transaction. The information 124 includes an account number, the date, the type of transaction, the amount of the transaction, and any other information used to identify the customer, the institution, or the transaction. As before, the adhesive transaction receipt 120 includes a subset of the information 124 which a customer may wish to place in an account register, such as a transaction type 126 and an amount of the transaction 128.

However, in this embodiment, the adhesive transaction receipt 120 is intended to be torn off of the complete receipt 110, moistened, and affixed to the account register 50 (FIG. 2). The adhesive transaction receipt 120 includes a lower surface 130 having a moistened-adhesive type adhesive. The adhesive will not exhibit adhesive properties until it is moistened, and the moistened adhesive will cure upon subsequent drying. This lick-and-stick type adhesive is commonly used for postage stamps and other labels. The transaction type 126 and the amount of the transaction 128 appear on an upper surface 132 of the adhesive transaction receipt 120. To facilitate the use of this type of adhesive transaction receipt 120, the adhesive transaction receipt 120 is printed along an edge 134 of the complete receipt 110. The edge 134 is perforated or scored to permit easy detachment. Many techniques for scoring or perforating detachable surfaces are known. The specific technique used is not important, however, it is important that the adhesive transaction receipt 120 be easily detachable from the complete receipt 110.

Figure 4:
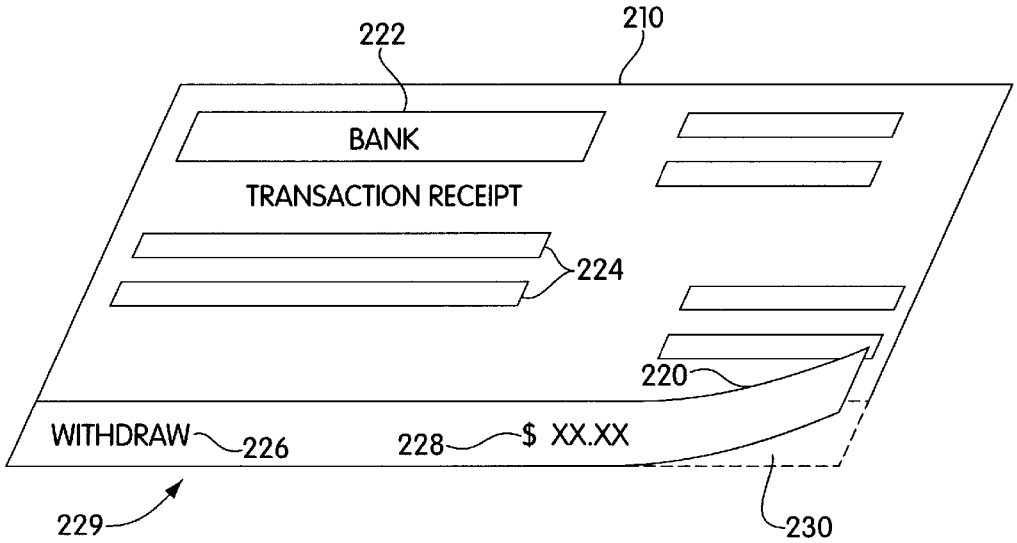
FIG. 4 shows an embodiment of a complete receipt including an adhesive transaction receipt that is moistened.

FIG. 4 shows an embodiment of a complete receipt 210 using another configuration for an adhesive transaction receipt 220. This embodiment uses a self-adhesive, peel-off type adhesive transaction receipt 220. The complete receipt 210 includes the name of an issuing institution 222, along with information 224 relating to a completed transaction. The information 224 includes an account number, the date, the type of transaction, the amount of the transaction, and any other information used to identify the customer, the institution, or the transaction. The adhesive transaction receipt 220 includes a subset of the information 224 which a customer may wish to place in an account register, such as a transaction type 226 and an amount of the transaction 228. In this embodiment, the adhesive transaction receipt 220 runs horizontally along a bottom edge 229 of the complete receipt 210. A release sheet 230 is positioned beneath the adhesive transaction receipt 220 to enable easy removal of the adhesive transaction receipt 220.

Figure 5:
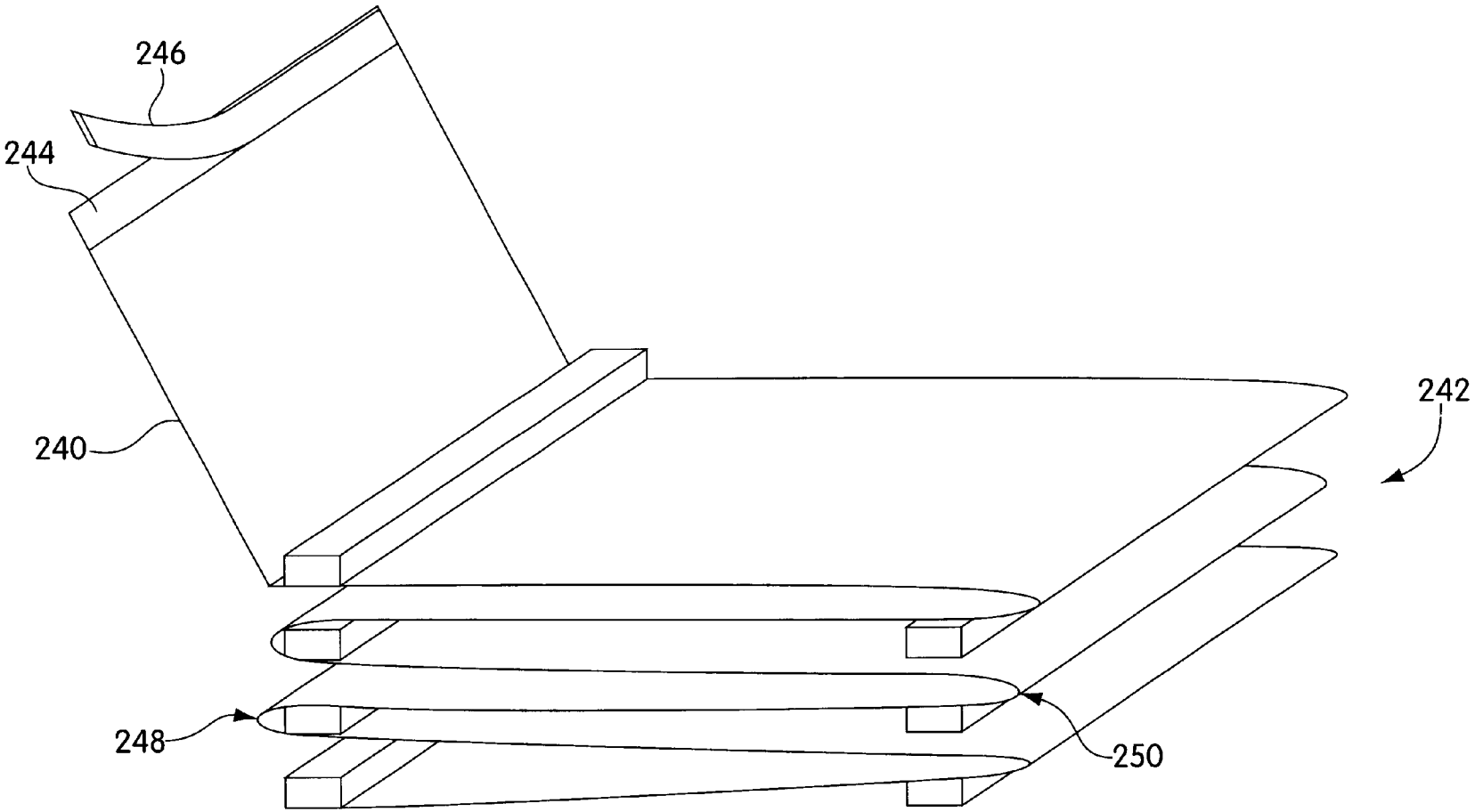
FIG. 5 shows a fan-fold of unprinted complete receipts.

A number of arrangements are possible for the release sheet 230 and the adhesive transaction receipt 220. The choice of a particular geometry will depend upon the manner in which the adhesive transaction receipt 220 is used by a customer, and the manner in which unprinted complete receipts 210 are manufactured, stored, and fed to a printer. For example, FIG. 5 shows unprinted complete receipts 240 arranged in a fan-fold 242. It is preferred to arrange the complete receipts 210 of FIG. 4 in this manner, because the relatively thicker release sheet 244 and adhesive transaction receipt 246 portions of the unprinted complete receipt 240 occur alternately on the left side 248 and the right side 246 of the fan fold 242, thereby reducing thickness of the overall stack of unprinted complete receipts 240.

Referring again to FIG. 4, another possible arrangement includes a release sheet 230 and an adhesive transaction receipt 220 covering the entire complete receipt 210, with perforations or scoring to permit removal of a selected portion thereof containing the desired transaction information. This arrangement works well with a stack of unconnected complete receipts. Another possible arrangement is a band of release sheet 230 and adhesive transaction receipt 220 along one side, permitting easier rolling of the unprinted complete receipts. The particular arrangement of the adhesive transaction receipt 220 on the complete receipt 210 is not important. It is important that the adhesive transaction receipt 220 can be easily detached from the complete receipt 210 in a shape and size that may be transferred to an account register 50 (FIG. 2).

A number of financial accounts are well known, such as checking accounts, savings accounts, money market accounts, and credit lines. Within these accounts, a number of transactions are also known, most typically deposits, withdrawals, and transfers. The present invention may be usefully practiced with any of these accounts and transactions, or other accounts and transactions not mentioned above, provided the transactions is memorialized in a printed transaction receipt.

Although the present invention has been shown and described with respect to preferred embodiments thereof, it should be understood by those skilled in the art that various other changes, omissions and additions to the form and detail thereof may be made therein without departing from the spirit and scope of the invention.

What is claimed is:

1. A complete receipt for a financial transaction, the complete receipt comprising:

information relating to the financial transaction; and an adhesive transaction receipt including an upper surface containing a record of an amount of the transaction and a record of a type of the transaction, the type being determined at a time of the transaction, and a lower surface comprising an adhesive, the adhesive transaction receipt being shaped and sized for transfer to an account register, the adhesive transaction receipt being removably attached to the complete receipt, and the adhesive transaction receipt being affixable to the account register, the adhesive comprising a moistenable adhesive and the adhesive transaction receipt being scored or perforated along one edge.

2. The receipt of claim 1, the adhesive transaction receipt further comprising a plurality of individual receipts, each individual receipt including a specific item of information relating to the financial transaction.

3. The receipt of claim 1, the adhesive comprising a self-adhesive, and the complete receipt further comprising a release sheet, the adhesive transaction receipt being adhered to the release sheet of the complete receipt in a non-permanent fashion.

4. The receipt of claim 1, wherein the upper surface of the adhesive transaction receipt further comprises a record of a date of the transaction.

5. The receipt of claim 1, wherein the upper surface of the adhesive transaction receipt further comprises a record of an account balance.

6. The receipt of claim 1, wherein the upper surface of the adhesive transaction receipt further comprises a record of an institution conducting the transaction.

7. The receipt of claim 1, wherein the adhesive transaction receipt is made of a transparent material.

8. The receipt of claim 1, wherein the upper surface of the adhesive transaction receipt further comprises a record of an account balance.

9. The receipt of claim 1, wherein the transaction is an Automatic Teller Machine (ATM) transaction.

10. A method for managing an account, the method comprising the steps of:

providing a complete receipt of a transaction at the time and place where the transaction takes place;

printing information relating to the transaction onto the complete receipt;

providing an adhesive transaction receipt, the adhesive transaction receipt being temporarily attached to the complete receipt;

printing a type of the transaction and an amount of the transaction onto the adhesive transaction receipt; and scoring or perforating the complete receipt to provide a plurality of individual receipts, each individual receipt including a specific item of information relating to the financial transaction.

11. The method of claim 10, further comprising the steps of:

removing the adhesive transaction receipt from the complete receipt; and permanently affixing the adhesive transaction receipt to an account register.

12. The method of claim 10, further comprising the step of printing a record of a date of the transaction onto the adhesive transaction receipt.

13. The method of claim 10, further comprising the step of printing a record of an account balance onto the adhesive transaction receipt.

14. The method of claim 10, further comprising the step of printing a record of an institution conducting the transaction onto the adhesive transaction receipt.

15. The method of claim 10, firther comprising the step of printing a credit card type or a credit card account number onto the adhesive transaction receipt.

* * * * *